US005896764A

United States Patent [19]

Monsch et al.

[11] Patent Number: 5,896,764

[45] Date of Patent: Apr. 27, 1999

[54] LOCK ADAPTED TO BE ACCOMMODATED WITHIN THE THICKNESS OF AN OPENING PANEL

[75] Inventors: Pierre Monsch, Saverne; André Lilas, Sarrebourg; Gérard Prevot, Willerwald, all of France

[73] Assignee: Ferco International Ferrures et Serrures de Batiment, Reding, France

[21] Appl. No.: 08/837,928

[22] Filed: Apr. 11, 1997

[30] Foreign Application Priority Data

Apr. 12, 1996 [FR] France ..... 96 04594

[51] Int. Cl.[6] ..... E05B 13/00

[52] U.S. Cl. ..... 70/107; 70/149; 70/218; 70/472; 292/150; 292/169.16; 292/DIG. 27

[58] Field of Search ..... 70/107–111, 422, 70/472, 149, 218, 188, 189, 204, 222, 223; 292/150, DIG. 4, DIG. 27, 169.14, 169.16, 169.22

[56] References Cited

U.S. PATENT DOCUMENTS

| | | | |
|---|---|---|---|
| 1,410,841 | 3/1922 | Simpson | 292/150 |
| 3,806,176 | 4/1974 | Massie | 292/150 |
| 4,974,883 | 12/1990 | Jans | 292/169 |

FOREIGN PATENT DOCUMENTS

| | | |
|---|---|---|
| 0535497 A1 | 4/1993 | European Pat. Off. . |
| 0712987 A2 | 5/1996 | European Pat. Off. . |
| 0712987 A3 | 5/1996 | European Pat. Off. . |
| 2657385 A1 | 7/1991 | France . |
| 1130323 | 5/1962 | Germany . |
| 9114609 | 3/1992 | Germany . |

*Primary Examiner*—Lloyd A. Gall
*Attorney, Agent, or Firm*—Stroock & Stroock & Lavan LLP

[57] ABSTRACT

A lock which can be accommodated within the thickness of an opening panel includes two nuts rotatable about a common axis and attached to respective corresponding operating members. Each nut can turn freely about its axis relative to the other nut. The latch bolt is attached to a selector member mobile between two predetermined positions in the transverse direction corresponding to the thickness of the casing of the lock. Each nut is attached to a corresponding arrangement of the lock adapted to engage with the selection member when the latter is in its position near the nut, in order to actuate the latch bolt when the nut is turned in a first direction corresponding to retraction of the latch bolt and to remain disengaged from the selector member when the latter is in its other position near the other nut.

20 Claims, 9 Drawing Sheets

LOCK ADAPTED TO BE ACCOMMODATED WITHIN THE THICKNESS OF AN OPENING PANEL

BACKGROUND OF THE INVENTION

1. Field of the Invention

The present invention concerns a lock adapted to be accommodated within the thickness of an opening panel, to be actuated from either side of said opening panel by an operating member and/or a key, and to allow retraction of the latch bolt from the outside only by means of the key, this lock having two nuts rotatable about a common axis and attached to respective corresponding operating members.

The present invention is generally concerned with a lock, an espagnolette bolt lock or the like, of the aforementioned type, for doors, French windows or the like.

2. Description of the Prior Art

Many different locks of this type are known in themselves and are generally in the form of espagnolette bolt locks adapted to operate simultaneously a latch bolt, a lock bolt and at least one operating link.

In locks of this known type the mechanical members or the functions of the lock are controlled differently according to whether the user is on the inside or on the outside of the opening panel fitted with the lock. The objective is to lock the opening panel as soon as the user leaves the room to which it gives access. It is a question of making the lock inviolable by a third party on the outside of the opening panel who does not have the key. The opening panel can be unlocked only with the key. It is the latch bolt that locks the opening panel. Locks of this kind are usually fitted to apartment front doors.

One such lock is described in FR-A-2 657 385, for example. This lock includes a conventional nut attached to the inside operating member and which assures all the functions of a conventional espagnolette bolt lock. It also has a second nut attached to the exterior operating member which is adapted to engage with the square shaft operating the first nut through coupling means such that the nut attached to the outside operating member has a lost motion in one direction or the other before it is able to entrain the main nut. This lost motion prevents operation of the latch bolt by the outside operating member.

This lock requires the use of a support plate that has to be applied to the exterior face of the opening panel. Also, it is not reversible, i.e. when the lock is fitted to the opening panel it is not possible to choose, from the point of view of an observer regarding the lock accommodated within the thickness of the opening panel, whether the righthand side or the lefthand side should correspond to the exterior of the room to which the opening panel provides access.

Other locks of the aforementioned type known in themselves include two conventional nuts. These locks are thicker than conventional locks with the result that they cannot be accommodated in the slot usually made within the thickness of an opening panel. This makes it necessary either to increase the width of the slot, which weakens the opening panel, or to transfer to the exterior of the lock, for example inside cover plates, functions for which the mechanical parts cannot be housed within a standard size lock casing.

An aim of the present invention is to eliminate the drawbacks of the systems known in themselves and to propose a lock of the aforementioned type that is very easily and very simply reversible and which enables all of the mechanisms of a lock of this kind to be housed within a standard thickness casing.

SUMMARY OF THE INVENTION

In accordance with the invention, in a lock of the aforementioned type:

- each nut is adapted to turn freely about its axis relative to the other nut,
- the latch bolt is attached to a selector member mobile in a transverse direction corresponding to the thickness of a casing of the lock between two predetermined positions, and
- each nut is attached to corresponding means of the lock adapted to engage with said selector member when the latter is in a position close to said nut to actuate the latch bolt when said nut is turned in a first direction corresponding to retraction of said latch bolt and to remain disengaged from said selector member when the latter is in its other position near the other nut.

Thus, to make the lock reversible, all that is required is to turn the latch bolt 180° about its axis and to move the selector member from one to the other of its two positions in order to authorize retraction of the latch bolt by only the nut corresponding to the operating member on the interior side of the opening panel.

In one beneficial version of the invention each nut cooperates with a corresponding flange rotatable about the axis of said nut and adapted to transmit the movement of a cylinder when the latter is actuated by the key and includes means for rotating said flange when said nut is rotated in said first direction to retract the latch bolt, and each flange includes a finger that engages with the selector member or remains disengaged from said selector member according to whether said member is in its position on the same side as the corresponding nut or in its other position.

In an advantageous version of the invention the two nuts are substantially symmetrical to each other about a median plane of the lock perpendicular to the common rotation axis of the nuts, the two flanges are also substantially symmetrical about said median plane, and each nut has on its lateral face on the same side as the lateral wall adjacent the casing of the lock a cylindrical projection coaxial with the nut and passing through a circular opening in the corresponding flange.

In this way it is possible to house all of the components of the lock within a conventional lock casing without it being necessary to limit the thickness and therefore the mechanical strength of the components and, consequently, the reliability of the lock. The opening in the lateral face of the lock casing assures strict alignment of the corresponding nut with its theoretical axis.

In a preferred version of the invention, each nut has on its cylindrical projection an attachment finger extending radially outwards from said projection and each flange has at the periphery of its circular opening a complementary curvilinear opening adapted to receive said attachment finger and to allow the finger of the corresponding nut to rotate the flange in the first direction without impeding operation of the flange by the key.

Other features and advantages of the present invention will emerge from the following detailed description.

BRIEF DESCRIPTION OF THE DRAWINGS

In the accompanying drawings, which are provided by way of non-limiting example only:

FIGS. 19A and 22A are views respectively similar to FIGS. 19 and 22, the locking finger being in its position retracted inside the latch bolt;

DETAILED DESCRIPTION OF THE PREFERRED EMBODIMENTS

Figure 1:
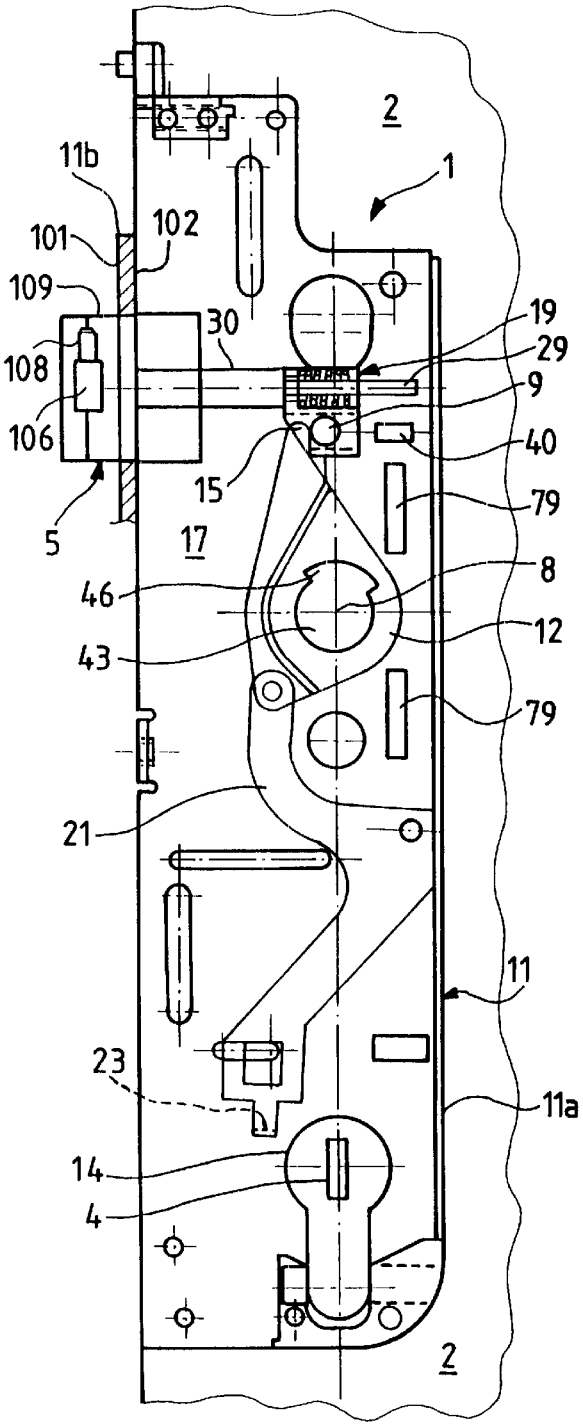
FIG. 1 is a simplified elevation view of one embodiment of a lock of the invention, many components having been removed to clarify the figure and the flange being in the position that corresponds to the normal deployed position of the latch bolt.

FIGS. 1 through 5 show a lock, to be more precise an espagnolette bolt lock 1 adapted to be accommodated within the thickness of an opening panel 2 and to be operated from each side of said opening panel 2 by an operating member 3 and a key 4 (see FIGS. 1 through 4) and to allow retraction of the latch bolt 5 from the outside only by means of the key 4.

It should be made clear that the following description concerns a lock or espagnolette bolt lock or the like, the opening panel 2 being a door, a French window or the like.

Figure 3:
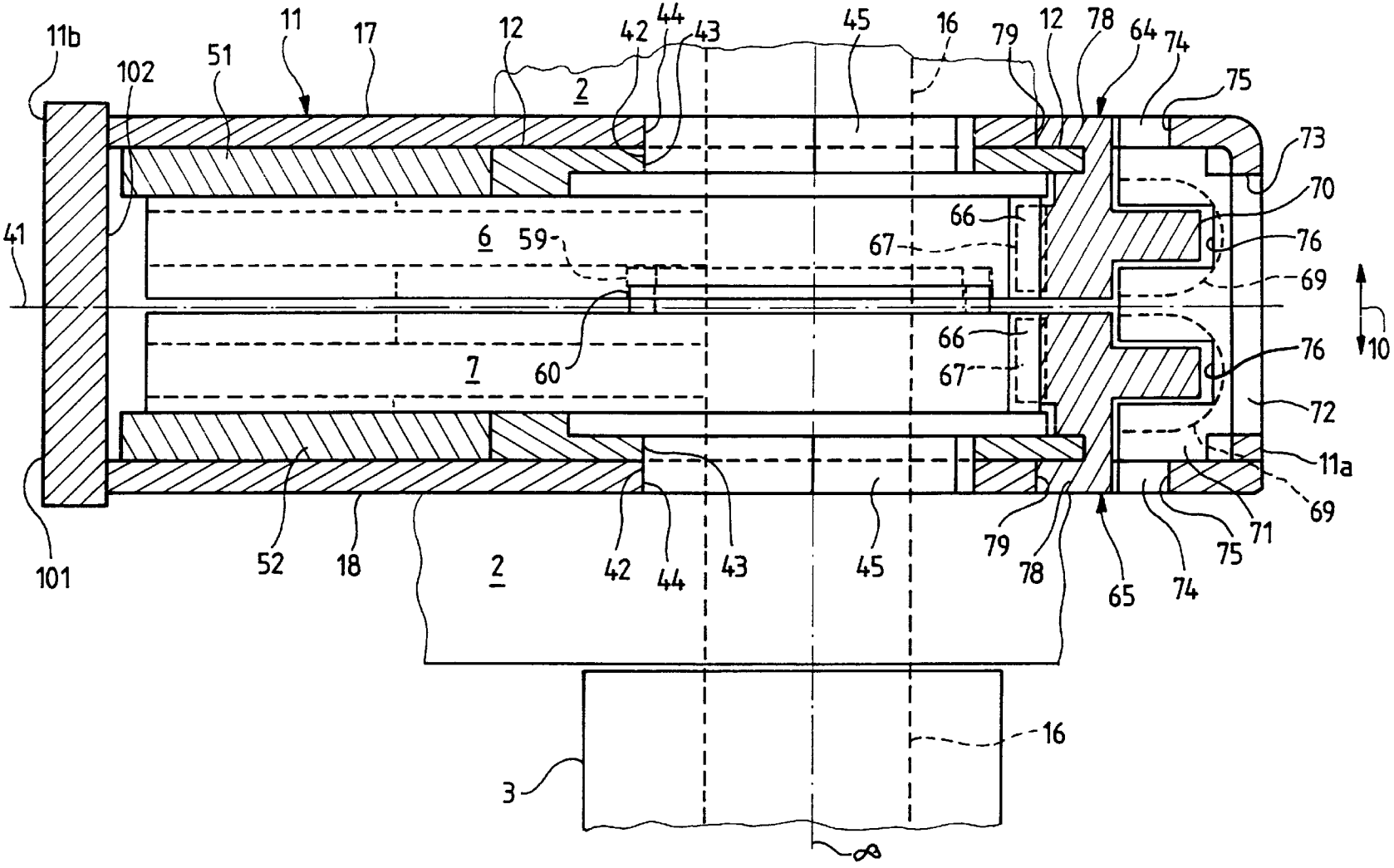
FIG. 3 is a cut-away plan view of the lock from FIG. 1.
Figure 4:
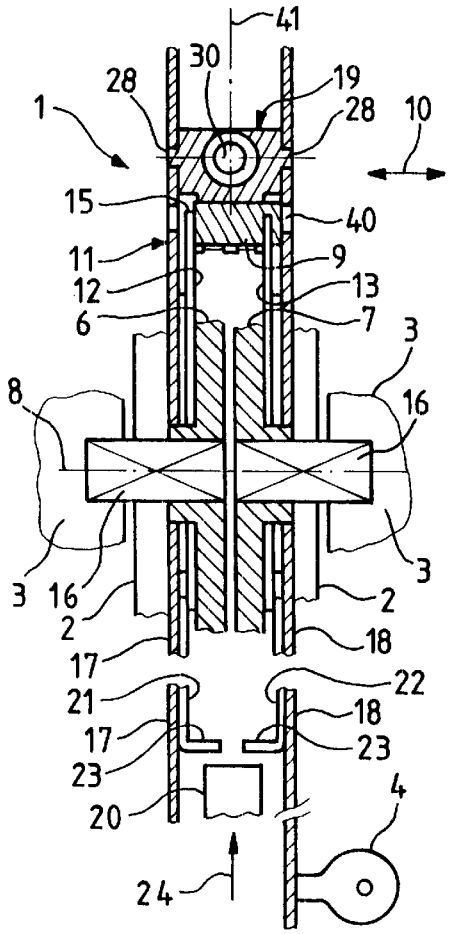
FIG. 4 is a cut-away fragmentary view of the lock from FIG. 1, as seen from the lefthand side of FIG. 1, and corresponding to what would be seen by an observer regarding the lock accommodated within the thickness of the open panel, the selector member being in the position in which the interior operating member is on the righthand side of the figure.
Figure 5:
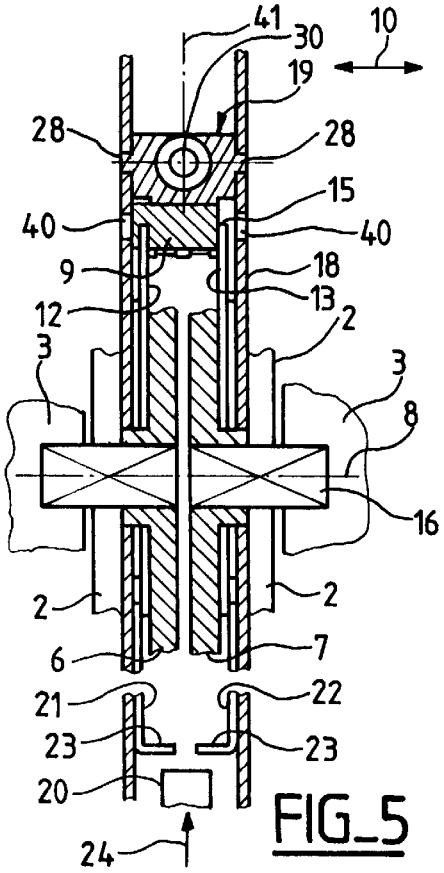
FIG. 5 is a view similar to FIG. 4, the selector being in its other position.

As shown in FIGS. 3, 4 and 5, the lock 1 includes two nuts 6, 7 rotatable about a common axis 8 and attached to a respective corresponding operating member 3.

In accordance with the invention, each nut 6, 7 is adapted to turn freely about its axis 8 relative to the other nut 7, 6; the latch bolt 5 is attached to a selector member 9 mobile between two predetermined positions in the transverse direction represented by the double-headed arrow 10 and corresponding to the thickness of the casing 11 of the lock; each nut 6, 7 is attached to corresponding means of the lock 1 adapted to engage with said selector member 9 when the latter is in its position near said nut, in order to actuate the latch bolt 5 when said nut 6, 7 is turned in a first direction corresponding to retraction of said latch bolt 5, and to remain disengaged from said selector member 9 when the latter is in its other position.

In the embodiment shown in the figures, each nut 6, 7 cooperates with a corresponding flange 12, 13 rotatable about the axis 8 of said nut 6, 7 and adapted to transfer the movement of the cylinder 14 when the latter is operated by the key 4. The nut 6, 7 further include means for rotating said flange 12, 13 when the nut 6, 7 is turned in the first direction to retract the latch bolt 5.

In the conventional way, and as shown in FIG. 3 in particular, the casing 11 has a metal backing plate—in this embodiment the lateral wall 17—bent to form the rear wall 11*a* of the casing. The rear wall 11*a* locates at the back of the slot formed in the thickness of an opening panel 2. The casing 11 is closed at the front by the front plate 11*b*, which is generally flush with the edge of the opening panel, and by a cover which constitutes the second lateral wall 18 of the casing 11.

To assemble the lock, its components are fitted in succession, beginning with those located near the lateral wall 17 and/or the rear wall 11*a* of the casing 11 and ending with those near the cover 18 and/or the front plate 11*b*.

FIG. 3 shows the assembled lock but FIG. 1 shows only the flange 12 disposed against the side wall 17 of the casing.

Each flange 12, 13 has at its upper end (see FIGS. 1 and 2) a finger 15 that engages with the selector member 9 or which remains disengaged from said selector member 9 according to whether the member 9 is in its position on the same side as the corresponding nut 6, 7 or in its other position on the same side as the other nut 7, 6.

This is shown in more detail in FIGS. 4 and 5, which show in diagrammatic form the two nuts 6, 7 respectively attached in the conventional manner to a square operating shaft 16 passing through the opening panel 2 and joined to the corresponding operating member 3. Each flange 12, 13 is disposed between the corresponding nut 6, 7 and the adjacent wall 17, 18 of the lock casing 11. As explained hereinafter, the selector member 9 is attached to a support 19 for the mobile bolt.

In the FIG. 4 embodiment, the selector member 9 is in its righthand position in the figure and is entrained by the flange 13 on the right in the figure and operated by the nut 7 that is also on the right in the figure. It can be seen that the flange 12 on the left in the figure and operated by the lefthand nut 6, which corresponds to the exterior face of the opening panel 2, remains disengaged from the selector member 9.

In FIG. 5, the selector member is in its lefthand position in the figure. The flange 12 operated by the nut 6 on the left in the figure is engaged with the selector member 9 whereas the flange 13 on the right in the figure and operated by the nut 7, which corresponds to the exterior face of the opening panel, remains disengaged from the selector member 9.

In a manner that is conventional in itself, the key bit 20 (FIGS. 4 and 5) attached to the cylinder 14 operated by the key 4 is adapted to engage with means respectively attached to the two flanges 12, 13 so as to actuate the latch bolt 5 regardless of the position of the selector member 9.

Figure 2:
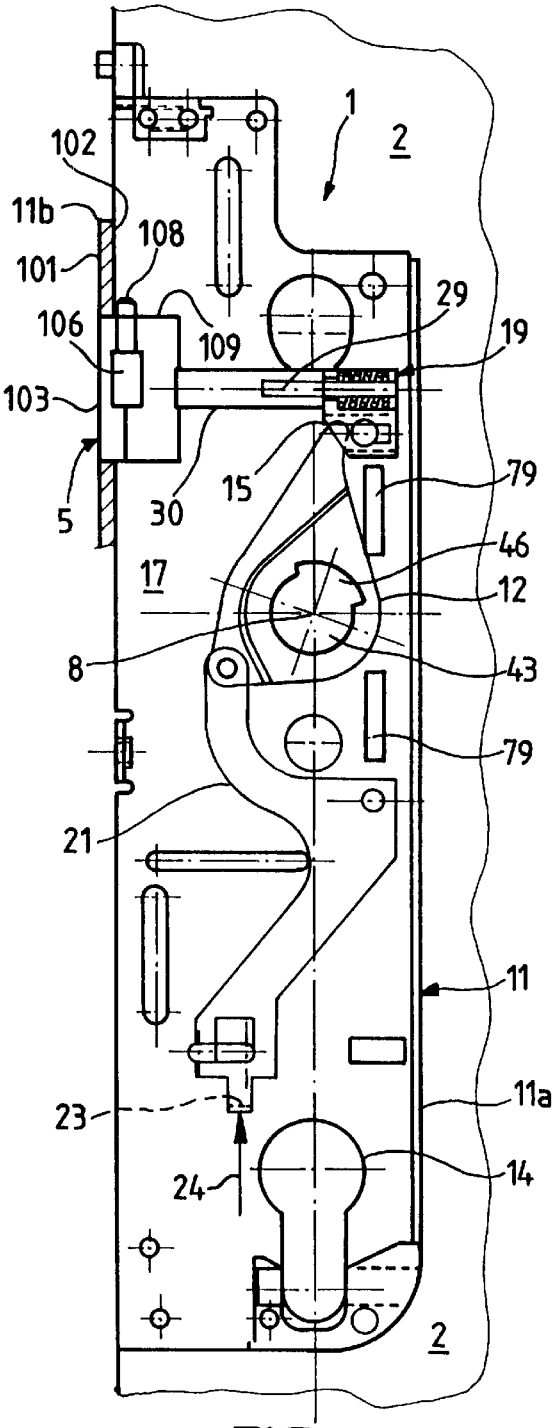
FIG. 2 is a view similar to FIG. 1, the flange being in the position that corresponds to the retracted position of the latch bolt.

In the embodiment shown in FIGS. 1 and 2 each flange 12, 13 is attached to a corresponding operating bracket 21, 22. FIGS. 4 and 5 show that each operating bracket 21, 22 has a bottom end 23 bent towards the other operating bracket 22, 21, i.e. towards the interior of the casing 11. Accordingly, the key bit 20 actuated by the key in the direction of the arrow 24 engages with the two bent over ends 23 and therefore raises the operating brackets 21, 22 and thereby rotates the two flanges 12, 13 to retract the latch bolt 5 regardless of the position of the selector member 9.

The support 19 of the latch bolt 5 is shown in detail in FIGS. 6, 6A, 6B and 7.

The support 19 has on each of its two lateral faces 26, 27 a guide button 28 that slides in a corresponding groove 29 in the adjacent wall 17, 18 of the casing 11. The tail 30 of the latch bolt 5 passes through the support. A spring 31 is housed in a chamber 32 of the support between a front wall 33 of the chamber 32 on the same side as the latch bolt 5 and a spring washer 34 fixed to the rear end of the tail 30.

The lower part 19*a* of the support 19 includes a cylindrical opening 35 in the direction 10 of the thickness of the casing 11 of the lock. The selector member 9 is a cylindrical member adapted to fit in the cylindrical opening 35.

Figure 6:
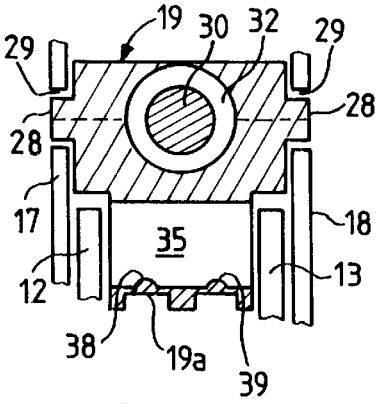
FIG. 6 shows a detail of FIG. 4 to a larger scale, the selector member not being shown.
Figure 7:
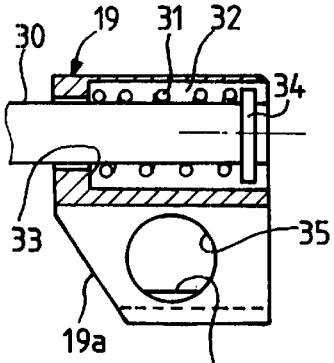
FIG. 7 is a cut-away view as seen from the righthand side of FIG. 6.

FIG. 6 shows that the bottom part 19*a* of the support 19 is narrower than the top part of said support in order to allow the finger 15 of each flange 12, 13 to pass between this bottom part and the adjacent wall 17, 18 of the casing 11.

Figure 6A:
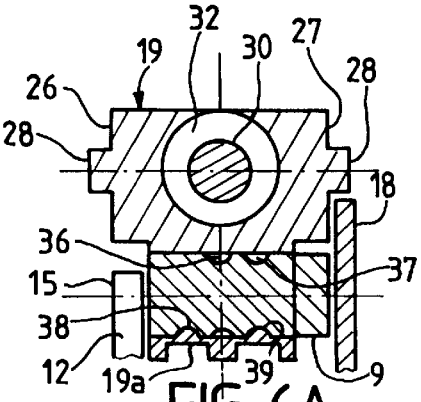
FIGS. 6A and 6B are views similar to FIG. 6, the selector member being respectively in the positions it occupies in FIGS. 4 and 5.
Figure 6B:
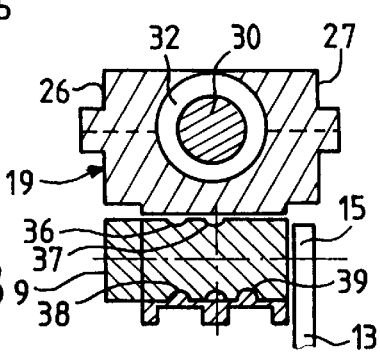

It can therefore be seen that the axial length of the cylindrical selector member 9 is determined so that, in its righthand position shown in FIG. 6A or in its lefthand position shown in 6B, the selector member 9 has a front face substantially in contact with the corresponding wall 17, 18 of the casing 11 and which therefore projects relative to the bottom part 19*a* of the support 19 to engage the finger 15 of the corresponding flange 12, 13. On the other hand, the other front face of the member 9 does not project out of the bottom part 19*a* of the support 19 and the finger 15 of the other flange 13, 12 remains disengaged from the selector member 9.

In the retracted position of the latch bolt 5 shown in FIG. 2, the finger 15 of the flange 12 has pushed the support 19 back towards the back 11 of the casing, towards the right in the figure, against the action of an opposing spring (as shown) which thereafter, in the conventional way, returns the support 19, the latch bolt 5, the flange 12 and the bracket 21 into their respective normal positions as shown in FIG. 1.

To locate the selector member 9 accurately, the latter member has on its exterior peripheral surface two grooves 36, 37 and the bottom part 19*a* has on its interior peripheral surface two beads 38, 39. It can be seen that the grooves 36, 37 and the beads 38, 39 are disposed so that in each of these two positions the member 9 has one groove, the righthand groove 37 in FIG. 6A or the lefthand groove 36 in FIG. 6B, engaged with the corresponding bead 39, 38, the other bead exercising a wedging effect to prevent any play of the selector member 9.

As shown in FIGS. 4 and 5 in particular, the casing 11 of the lock advantageously has in at least one lateral wall 17, 18 an opening 40 enabling the insertion of a small tool from the exterior of the casing 11 to move the selector member 9 towards the other wall.

To select in this way the righthand side or the lefthand side corresponding to the exterior of the opening panel, it is sufficient to carry out the following two simple operations before inserting the lock 1 into a slot in the thickness of the opening panel 2:

using a pointed tool inserted from the rear of the casing, the latch bolt 5 is removed completely from the casing 11 in order to rotate it 180° on its axis;

the same tool is inserted into the opening 40 in the lateral wall 17, 18 of the casing 11 to push the selector member 9 towards the other wall 18, 17.

In the embodiment shown in the figures, the two nuts 6, 7 are substantially symmetrical to each other about the median plane 41 of the lock 1 perpendicular to the common rotation axis 8 of the nuts 6, 7. The two flanges 12, 13 are also substantially symmetrical relative to said median plane 41 (see FIG. 3, 4 and 5 in particular).

In the example shown in detail in FIG. 8, 8A, 8B, 9, 9A and 9B, each nut 6, 7 has on its lateral face 6*a*, 7*a* facing the adjacent lateral wall 17, 18 of the casing 11 a cylindrical projection 42 passing through a circular opening 43 in the corresponding flange 12, 13 and a circular opening 44 in the adjacent lateral wall 17, 18 of the casing 11. This circular projection 42 centers the flange 12, 13 accurately relative to the corresponding nut 6, 7 and centers the nut 6, 7 accurately relative to the corresponding wall 17, 18.

The figures also show that each nut 6, 7 has on its cylindrical projection 42 an attachment finger 45 extending radially towards the exterior of the projection 42.

In a complementary manner, each flange 12, 13 has at the periphery of its circular opening 43 a complementary curvilinear opening 46 adapted to receive the attachment finger 45 of the corresponding nut 6, 7 and to allow the flange 12, 13 to be rotated in the first direction by the attachment finger 45 of the corresponding nut 6, 7 in order to retract the latch bolt, without impeding actuation of said flange 12, 13 by means of the key 4 to carry out the same operation.

The lock of the invention is preferably an espagnolette bolt lock adapted to actuate at least one operating link 47 having a free end 47*a* adapted to enter the keeper 48 of a corresponding auxiliary lock of the frame 49, as will be explained hereinafter with reference to FIGS. 15B and 15C.

To this end, each nut 6, 7 is adapted to rotate in the second direction opposite to the first direction from its rest position and has means adapted to engage with complementary means attached to said link 47 so that, starting from the rest position of the nut 6, 7, the link 47 is deployed as the nut 6, 7 is turned in the second direction and so that the link 47 is retracted when the nut 6, 7 is turned in the first direction (see below).

The lock therefore includes for each nut 6, 7 a plate 51, 52 mobile in the longitudinal direction of the link 47 (arrow 53) and attached to the latter. Each nut 6, 7 and the corresponding plate 51, 52 include respective complementary means for converting the circular movement of the nut 6, 7 in either direction into a rectilinear displacement of the plate 51, 52 in either direction (arrow 53).

Figure 9:
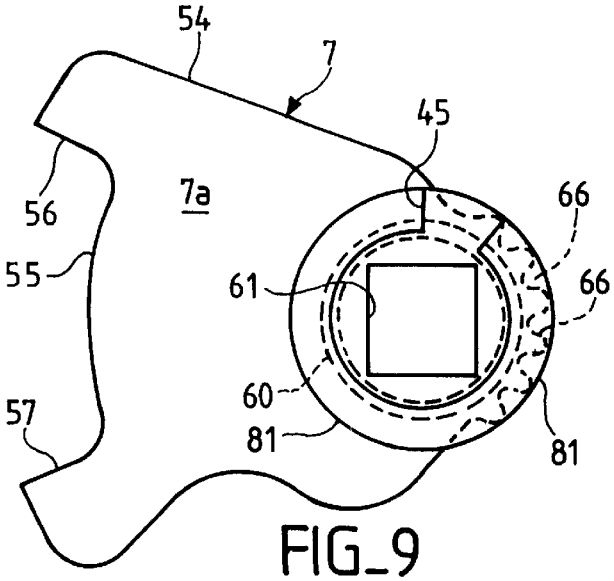
FIG. 9 is an elevation view of the nut in the righthand part of FIGS. 4 and 5 in the bottom part of FIG. 3.
Figure 9A:
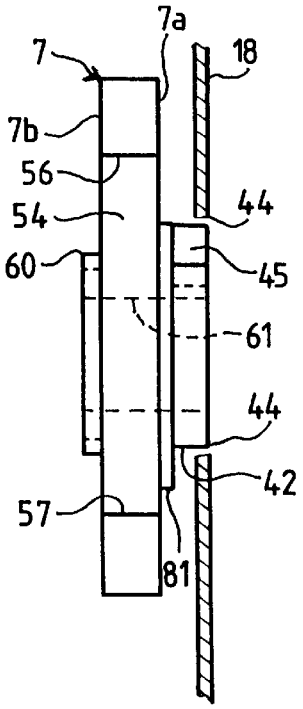
FIGS. 9A and 9B are respectively lefthand side and top views of the nut from FIG. 9.
Figure 9B:
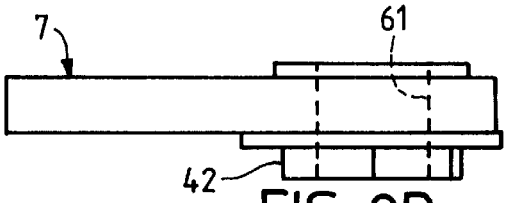
Figure 8:
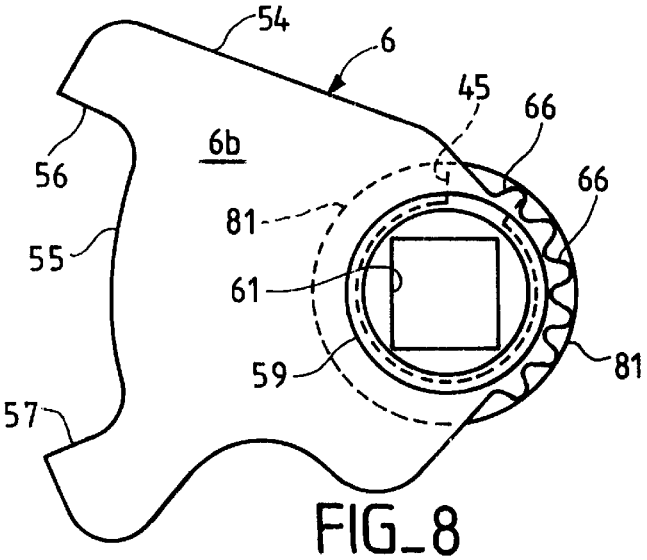
FIG. 8 is an elevation view of the nut which is in the lefthand part of FIGS. 4 and 5 in the top part of FIG. 3.
Figure 8A:
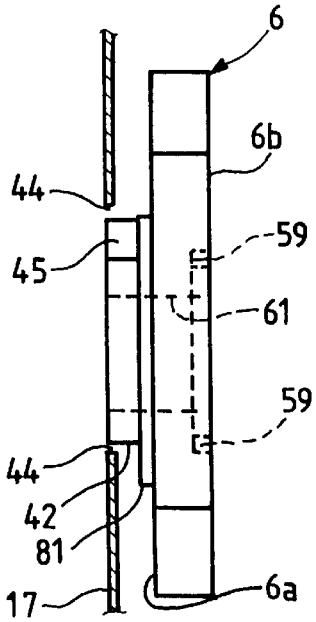
FIGS. 8A and 8B are respectively lefthand side and top views of the nut from FIG. 8.
Figure 8B:
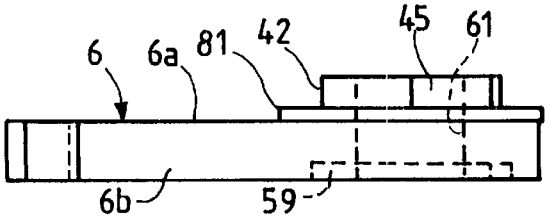
Figure 10A:
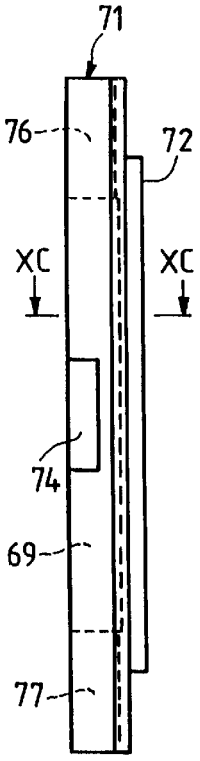
FIGS. 10A, 10B and 10C are respectively righthand side and top views and a sectional view taken along the line XC—XC in FIG. 10A of the rack support from FIG. 10.
Figure 10:
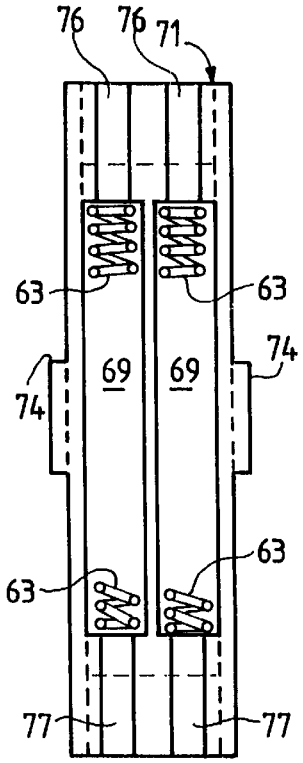
FIG. 10 is a front view of the rack support of the FIG. 3 embodiment of the lock.
Figure 11:
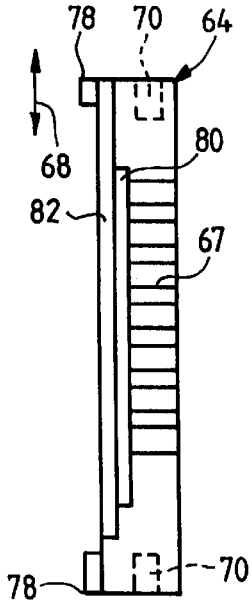
FIG. 11 is a front view of the rack mobile member which is inserted into the lefthand part of the support from FIG. 10.
Figure 12:
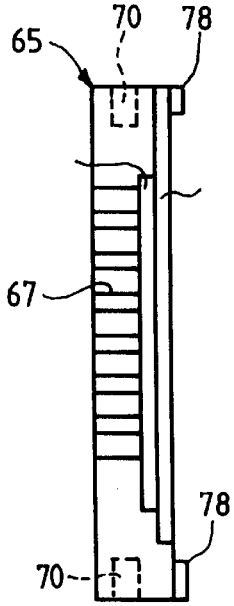
FIG. 12 is a front view of the rack mobile member which is inserted in the righthand part of the support from FIG. 10.
Figure 10B:
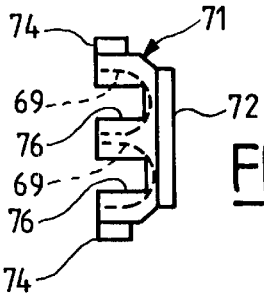
Figure 10C:
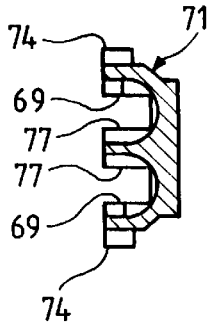
Figure 11A:
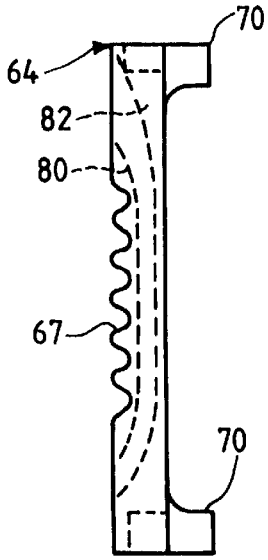
FIGS. 11A and 11B are respectively a righthand side view and a top view of the rack mobile member from FIG. 11.
Figure 12A:
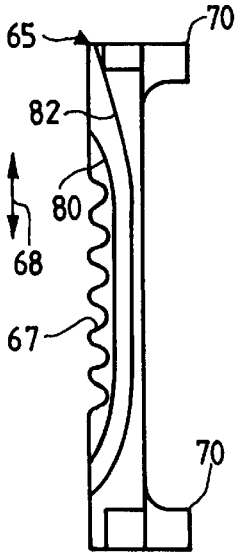
FIGS. 12A and 12B are respectively a righthand side view and a top view of the rack mobile member from FIG. 12.
Figure 11B:
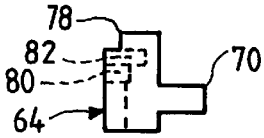
Figure 12B:
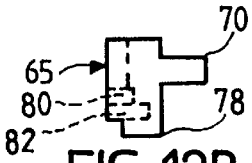

In the embodiment of FIGS. 8 and 9 the nut 6, 7 includes a flange 54 having a peripheral contour in the shape of a circular sector 55 delimited at both ends by a radially outwards projecting tooth 56, 57 adapted to entrain a conjugate lug of the plate 51, 52.

The lock preferably includes means for guiding rotation of the two nuts 6, 7 relative to each other.

In the example shown in FIGS. 8 and 9, the lefthand nut 6 has a circular groove 59 on its lateral face 6*b* opposite the cylindrical projection 42. The righthand nut 7 has a circular ring 60 on its lateral face 7*b* opposite its circular projection 42 adapted to enter the circular groove 59 of the nut 6 to center and to guide accurately rotation of the two nuts 6, 7 relative to each other.

As an alternative to this, a circular groove could obviously be provided on each of the two nuts with a ring adapted to enter each of the two grooves.

Of course, in the conventional way each nut 6, 7 has a square cross-section axial opening 61 through it adapted to receive a square operating shaft 16.

In order to return each operating member and each nut automatically to its rest position after any maneuver, the lock includes, for each nut, means adapted to cooperate with a return spring 63 in order to return the nut 6, 7 to its rest position.

The lock includes, for at least one nut, and in the example shown for each nut 6,7:

a member 64, 65 mobile inside the casing 11 of the lock 1 and adapted to be moved in a longitudinal direction when the nut 6, 7 turns about its axis 8 in a first direction against the action of the return spring 63 or is moved in the opposite direction by the action of said spring 63; and means attached to the nut 6, 7 adapted to cooperate with complementary means attached to the mobile member 64, 65 to convert rotation of the nut 6, 7 about its axis 8 into longitudinal movement of the mobile member 64, 65 and vice versa.

In this example, the means attached to the nut 6, 7 are pinion means 66 centered on the axis 8 of the nut 6, 7 and the complementary means attached to the mobile member 64, 65 comprise a rack 67 meshing with the pinion means 66. The teeth of the pinion means 66 are therefore adapted to mesh with the teeth of the rack 67 in any manner that is known in itself.

In the example shown in FIGS. 10, 10A through 10C, 11, 11A, 11B, 12, 12A, 12B the spring 63 is a coil spring extending in the longitudinal direction 68 of the mobile members 64 and 65 within a housing 69 in the casing 11 and the mobile member 64, 65 has at least one projecting member 70 adapted to engage with a corresponding end of the spring 63. In this example, the direction 68 is the vertical direction when the lock is fitted in an opening panel.

In this example, because each nut 6, 7 is adapted to be turned in both directions from its rest position, each mobile member 64, 65 has two projecting members 70 adapted to engage with respective ends of the spring 63.

In the example shown, the housings 69 of the two springs 63 are disposed one beside the other in a rack support 71 adapted to be placed at the rear of the casing 11 of the lock 1 (see FIG. 3).

The rack support 71 therefore has on its dorsal face a plate 72 adapted to be accommodated in a corresponding opening 73 in the back wall 11*a* of the casing 11 (see FIG. 3).

The support 71 also has on its lateral face an outwardly projecting lug 74 adapted to be inserted into a corresponding opening 75 in the respective wall 17, 18 of the casing 11 (see FIG. 3).

The housings 69 of the spring 63 are extended in the direction 68 which is the vertical direction when the lock is fitted to an opening panel by top and bottom grooves 76 and 77 in which the projecting lugs 70 on the mobile members 64 and 65 slide.

The sliding motion of each mobile member 64, 65 is additionally guided by two lateral lugs 78 moving in respective opening 79 in the corresponding lateral walls 17, 18 of the casing 11 (see FIGS. 1, 2 and 3).

To facilitate guidance of the moving part, each mobile member 64, 65 has along the rack 67, on the same side as the adjacent lateral wall 17, 18 of the casing 11, a first cut-out 80 for a web 81 reinforcing the teeth 66 of the corresponding nut 6, 7 and a deeper second cut-out 82 for the corresponding flange 12, 13.

A novel subassembly for returning a nut to its idle position has thus been described. This compact and highly reliable subassembly has the advantage of completely freeing the part of the lock in front of the square shafts driving the nuts and that it can be housed to the rear of the square operating shafts in an available space of the casing.

Figure 13:
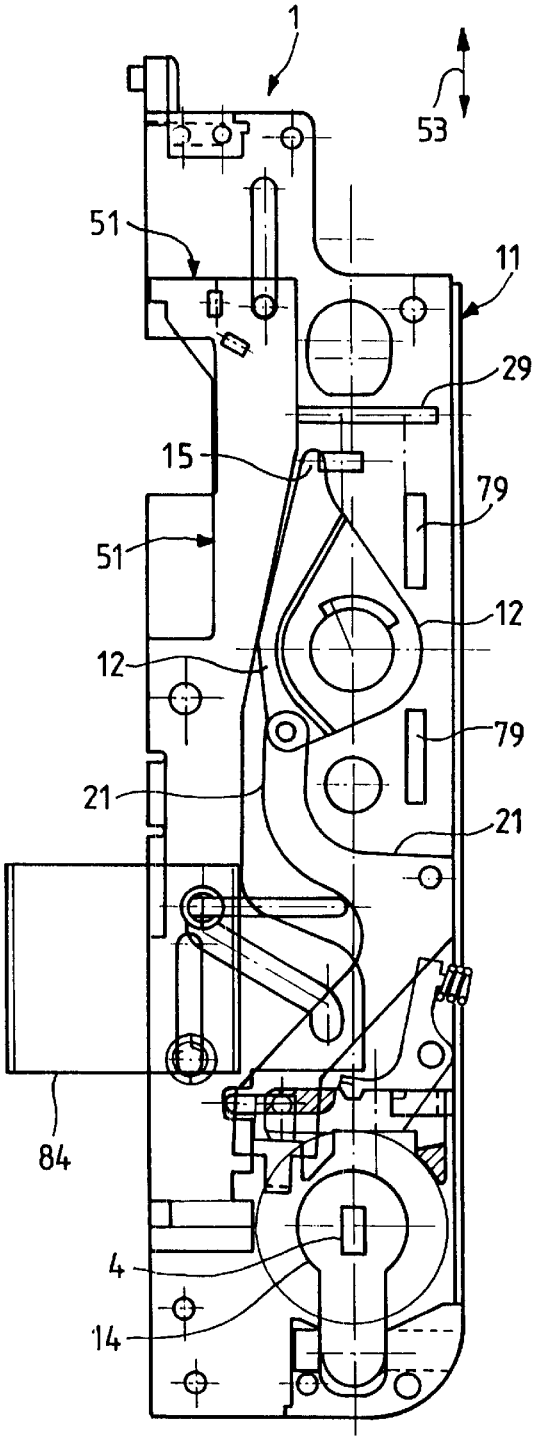
FIGS. 13 and 14 are views similar to FIGS. 1 and 2, respectively, additionally showing the plate operating a link, a lock bolt and a lock cylinder.
Figure 14:
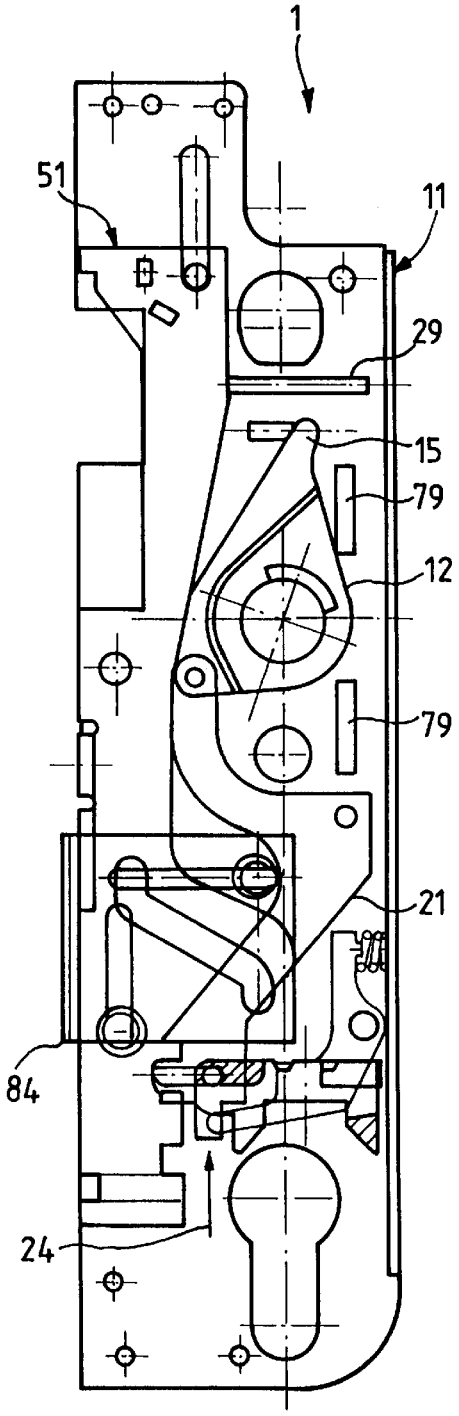

FIG. 13 shows the bracket 21 operating the flange 12, enabling the flange 12 to be operated by means of the key 4. The lock bolt 84 is also shown in its deployed position, this bolt being operated by means of the key. The plate 51 is also shown. The bracket 21 and the flange 12 are in the position corresponding to the unoperated position of the lock, with the latch bolt 5 deployed in the normal way. In the situation shown in FIG. 14, the lock bolt 84 has been retracted by turning the key, after which further operation of the key has applied an upward force to the bottom end of the bracket 21 (arrow 24) which has caused the flange 12 to rotate clockwise (as seen in the figure) to retract the latch bolt.

Figure 15B:
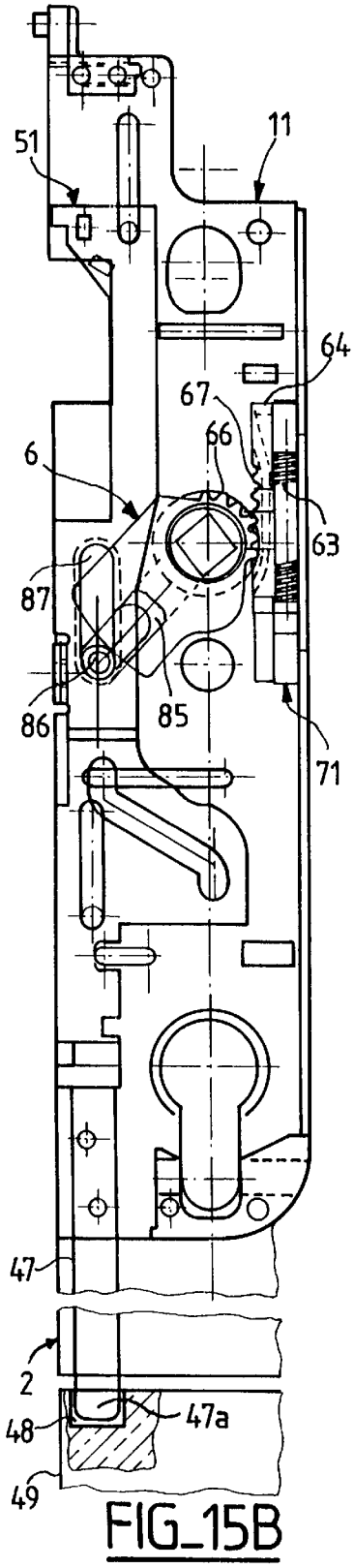
FIGS. 15A, 15B and 15C are views similar to FIG. 14 showing a different embodiment of a lock of the invention, the nut being shown in its idle position, its bottom position and its top position, respectively.
Figure 15A:
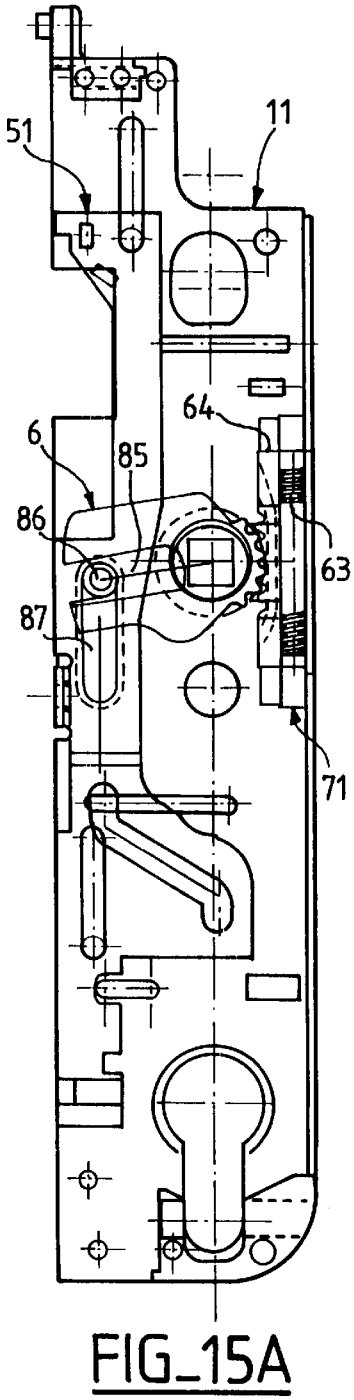
Figure 15C:
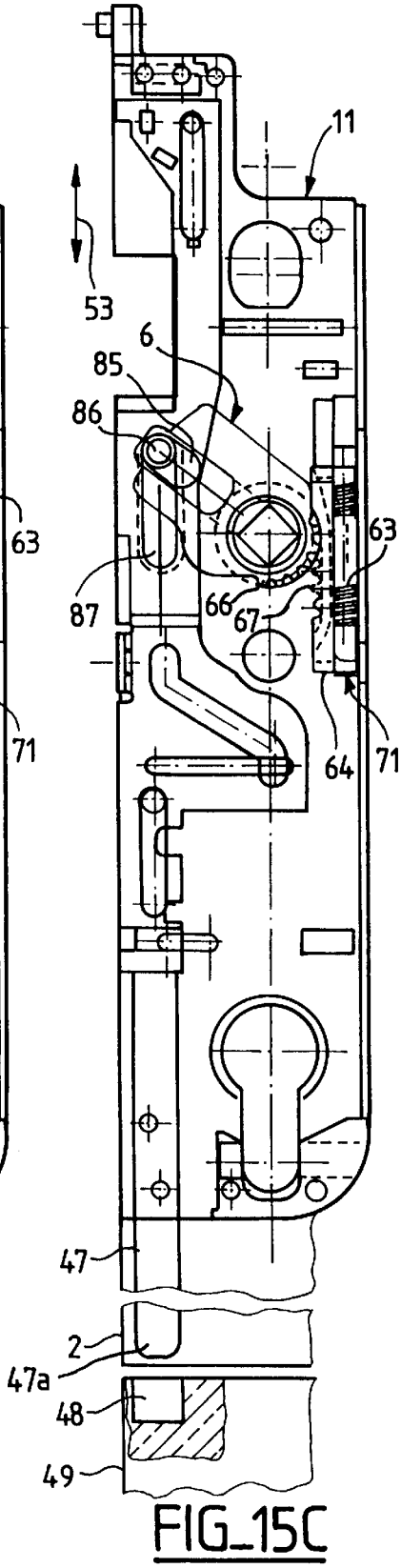

FIGS. 15A, 15B and 15C show another embodiment in which each nut 6, 7 has a flange with a radial slot 85 in which slides a lug 86 also adapted to slide in an opening 87 in the corresponding plate 51, 52. The slot 87 extends in the longitudinal direction of the link 47, i.e. the vertical direction in the figures, and has a length that corresponds to the lost motion needed to allow the nut 6, 7 to be returned to its rest position after operation of the link 47 without displacing the latter, by the spring 63 which applies thrust to the racks 67 which mesh with the pinions 66 of the nuts 6, 7.

FIGS. 16 through 18 and 18A through 18C show various embodiments of the opposite ends of two square or rather half-square shafts 16 that must be fastened together in the longitudinal direction of the axis 8 but free to rotate relative to each other.

Figure 16:
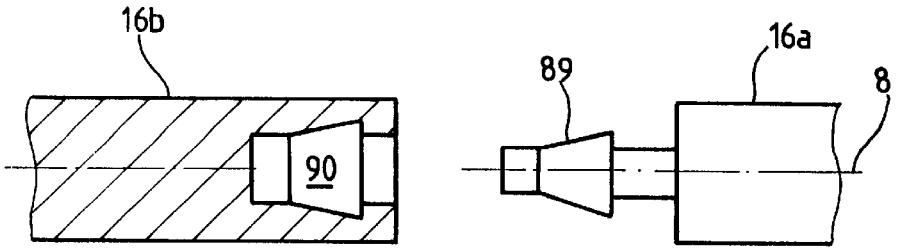
FIG. 16 is a part-sectional diagrammatic elevation view of one embodiment of respective ends of two square operating shafts.

In the FIG. 16 embodiment, the end of the righthand square half-shaft 16*a* is configured as a male member 89 adapted to be inserted and accommodated in the other end 16*b* which is configured as a female member 90 of conjugate shape to that of the male member 89.

The male and female members 89 and 90 are bodies of revolution about the common axis 8.

Figure 17:
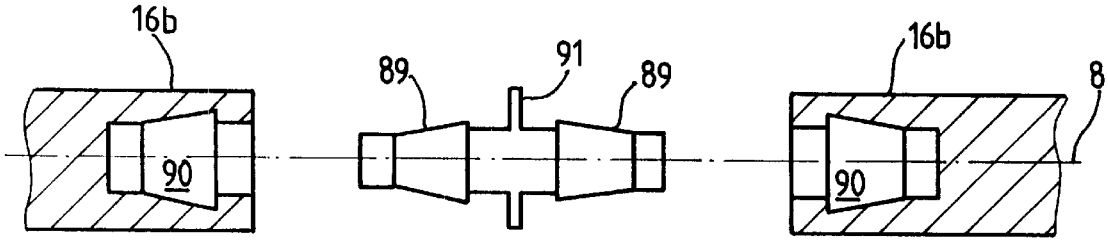
FIG. 17 is a view similar to FIG. 16 of a different embodiment of the ends of the square operating shafts.

In the FIG. 17 embodiment, each end of the square half-shaft 16*b* has a female configuration 90 and an assembly member 91 having a male configuration 89 at each axial end is disposed axially between the two ends 16*b*.

Figure 18:
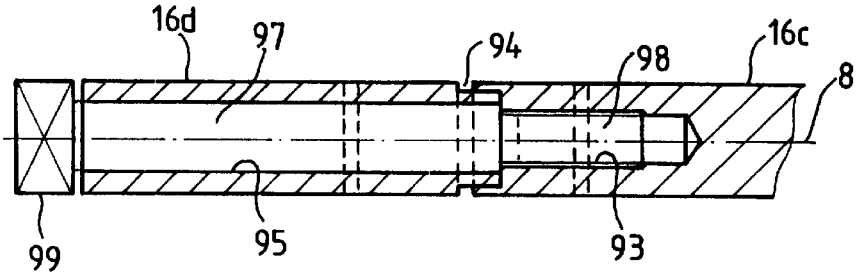
FIG. 18 is a view similar to FIG. 16 of a further embodiment of the ends of the square operating shafts.
Figure 18A:
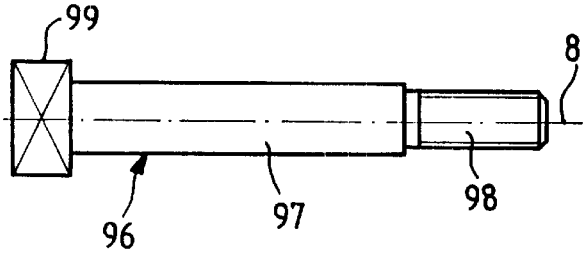
FIGS. 18A, 18B and 18C are views similar to FIG. 18 and respectively showing the three components of the assembly from FIG. 18.
Figure 18B:
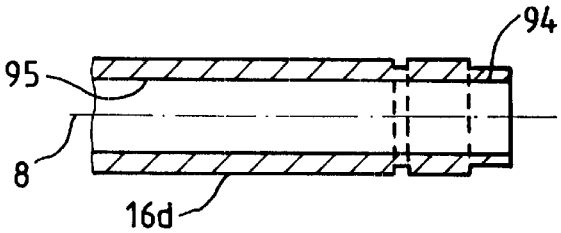
Figure 18C:
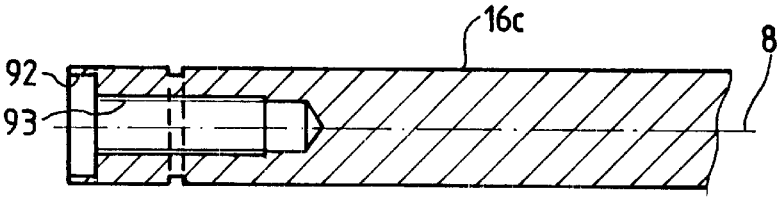
Figure 19:
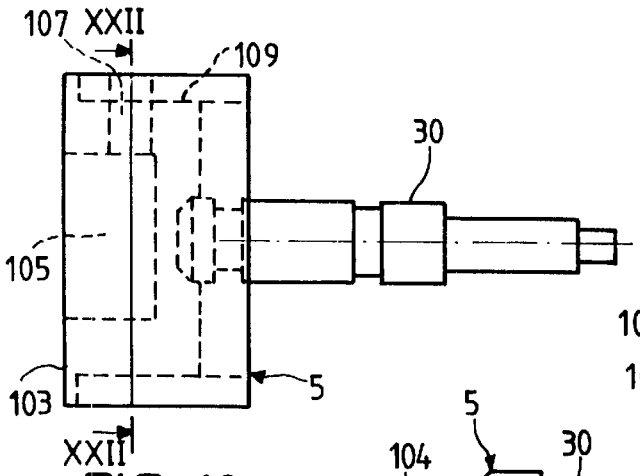
FIGS. 19, 20, 21 and 22 are respectively an elevation view, a lefthand side view, a fragmentary top view and a sectional view taken along the line XXII—XXII in FIG. 19 of one embodiment of the latch bolt of the lock from FIG. 1, the slider and the locking finger carried by the slider not being shown.
Figure 20:
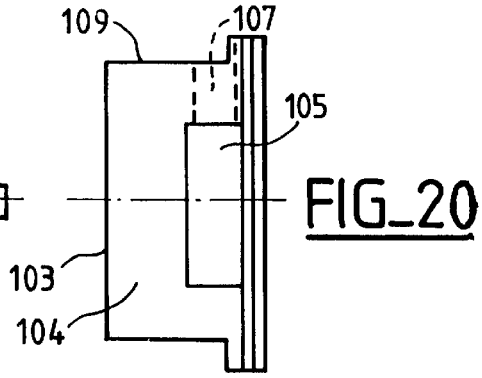
Figure 21:
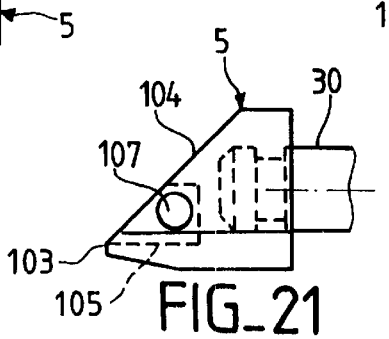
Figure 22:
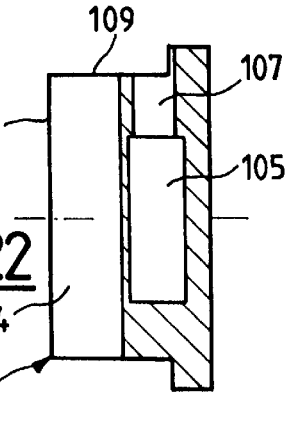
Figure 19A:
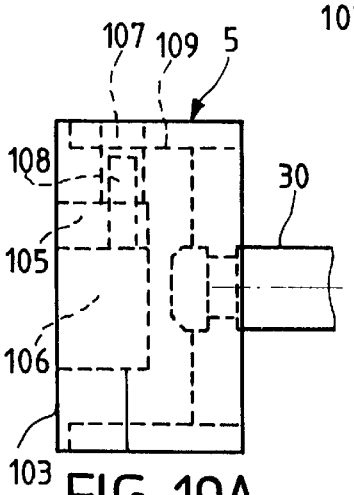
Figure 20A:
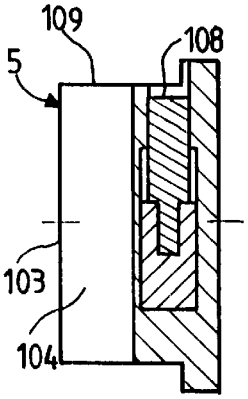
Figure 19B:
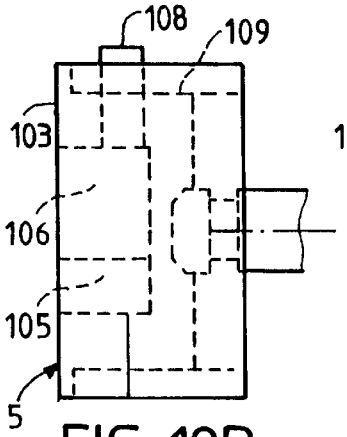
FIGS. 19B and 22B are views respectively similar to FIGS. 19 and 22, the locking finger being in its position deployed relative to the latch bolt.
Figure 22B:
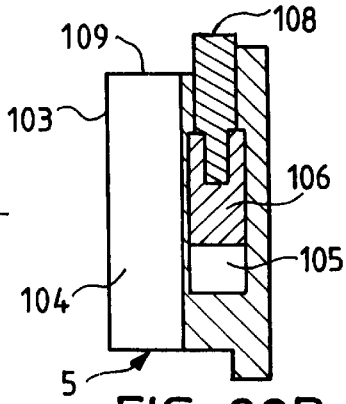

In the embodiment of FIGS. 18 and 18A through 18C the righthand square half-shaft 16*c*, shown in FIG. 18C, has, starting from the left, a first cylindrical opening 92 with a short axial length followed by a second cylindrical opening 93 the cylindrical inside wall of which is screwthreaded.

The lefthand half-square shaft 16*d* shown in FIG. 18B has at its righthand end a ring 94 adapted to penetrate the first cylindrical opening 92 and has an axial bore 95 throughout its length. A screw 96 has a cylindrical body 97 adapted to penetrate the bore 95 extended by a screwthreaded end 98 adapted to be screwed into the screwthread of the cylindrical opening 93. The screw 96 has a head 99 with a square cross-section identical to the cross-section of the square operating shafts 16. The square head 99 is adapted to be inserted at the same time as the lefthand end of the lefthand square half-shaft 16*d* into the complementary square cross-section opening of an operating member 3, with the result that the screw 96 cannot turn relative to said lefthand square shaft 16*d*. What is more, the screwthreaded cylindrical opening 93 and the screwthreaded end 98 allow free rotation of one of the square half-shafts 16*c*, 16*d* relative to the other 16*d*, 16*c*, in either sense, by an angle corresponding to the normal rotation of an operating member.

The lock of the present invention may be fitted with a device enabling the user of said lock to go out without their key, preventing closure and locking of the door by the latch bolt, which would lock them out.

To this end, the lock includes means for manually immobilizing the latch bolt 5 relative to the front plate 11*b* in a position in which said bolt 5 is retracted inside the casing 11 of the lock. Immobilized in this way, the latch bolt 5 cannot return to its deployed position to lock the opening panel and prevent the opening of said opening panel from outside without using the key.

The grooves 29 in the lateral walls 17, 18 of the casing 11 that retain and guide the buttons 28 on the support 19 of the latch bolt can then have, towards the back wall 11*a* of the casing, a width slightly greater than the normal width of said grooves and a length slightly greater than that required to return the latch bolt to its normal retracted position flush with the exterior surface 101 of the front plate 11*b*, as shown in FIG. 2.

All that the user has to do is to push the latch bolt 5 into the casing 11 so that the edge 103 on the bevel 104 of the latch bolt 5 lies to the rear of the interior surface 102 of the front plate 11*b*. The user can then push the bevel 104 upwards or downwards so that the corresponding end of the edge 103 of the bevel 104 abuts against the interior surface 102 of the front plate 11*b*. All that is required to release the latch bolt 5 to enable it to return to its normal position and resume its normal functions is to actuate the operating member or to intervene manually on the latch bolt.

In the embodiment shown in FIGS. 19, 19A, 19B, 20, 21, 22, 22A, 22B, 23A and 23B the bevel 104 of the latch bolt 5 has a cavity 105 near its edge 103 extending over a middle part of the height of said bevel 104 (see FIGS. 19, 20, 21 and 22). This cavity 105 receives a slider 106 extending over part only of the height of cavity 105 and mobile inside said cavity 105 in the direction of the height of the latter (see FIGS. 19A and 19B, 22A and 22B), which is the vertical direction when lock is fitted to an opening panel. In the example shown the slider 106 has a cross-section that completely fills the cavity 105, its bevel 110 reconstituting the bevel 104 of the latch bolt 5 (see FIGS. 23A and 23B in particular).

Figure 23A:
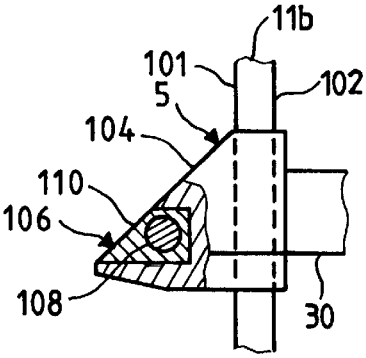
FIGS. 23A and 23B are cut-away views similar to FIG. 21 showing the latch bolt relative to the front plate respectively in the deployed position of the bolt, the locking finger being in its retracted position, and in the retracted position of said bolt, the locking finger in the deployed position abutting on the interior surface of the front plate and holding the bolt in its retracted position.
Figure 23B:
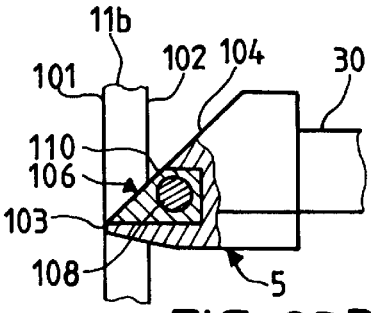

The cavity 105 communicates with a second cavity 107 formed in the mass of the bolt 5, extending from the cavity 105 in the heightwise direction of the bevel 104 and as far as the exterior surface 109 of the latter. The slider 106 carries a finger 108 adapted to slide in said second cavity 107 when the slider 106 slides in the first cavity 105. As shown in FIGS. 19A, 19B, 22A and 22B in particular, the length of the finger 108 is such that the finger 108 is flush with the corresponding surface 109 of the latch bolt 5 when the slider 106 is in its position distant from the second cavity 107 (FIGS. 19A and 22A) and projects relative to said surface 109 when the slider 106 is in its position near the second cavity 107, so as to abut the interior surface 102 of the front plate 11*b*, as shown in FIGS. 2 and 23B.

The surface 110 forming the bevel of the slider 106 is roughened by any method known in itself, for example by striations. To immobilize the latch bolt 5 within the casing 11, all that a user has to do is to push the latch bolt inside the casing and to push the rough surface 110 of the slider 106 upwards in order to slide the latter upwards and to deploy the finger 108 relative to the corresponding surface 109 of the bolt 5 so that it abuts on an interior surface 102 of the front plate 11*b*.

To return the bolt 5 to its normal position and its normal function, all that is required is to carry out the opposite maneuver, to push the bolt 5 slightly into the casing 11 and to push the rough surface 110 of the slider 106 downwards, so as to cause the finger 108 to re-enter the interior of the bolt 5.

There is described hereinabove and with reference to the figures a lock or an espagnolette bolt lock having the following features and providing the following functions:

- all the components of the lock can be accommodated inside a casing of standard size, both in respect of the thickness and in respect of the distance between the axis 8 of the nuts and the axis of the cylinder 14;
- the lock is very easily reversible: two very simple operations enable it to be adapted during fitting to suit the respective sides of the opening panel corresponding to the exterior and to the interior of the latter;
- the interior operating member turned in a sense corresponding to the retraction of the latch bolt retracts the links of auxiliary locks, where applicable retracts a lock bolt by means of a groove in the plate, and of course retracts the latch bolt;
- by turning the interior operating member in the opposite sense, the links of the auxiliary locks are deployed, together with a lock bolt where applicable; these components can be locked in this position by a latch actuated by the cylinder operated by the key;
- the exterior operating member provides all the above functions except for retraction of the latch bolt;
- all of the above maneuvers can be effected by means of the key from either side of the opening panel;
- the latch bolt 5 can be immobilized in its position retracted within the casing 11 by causing it to press on the interior surface 102 of the front plate 11*b*: the latch bolt 5 can no longer lock the door closed, allowing a user to go out without their key.

In the above description, the openings have in the conventional way a respective predetermined angular or rectilinear dimension enabling a travel at least equal to the displacement of the locking members (lock bolt, latch bolt, links) for both locking and unlocking operations, a corresponding travel of the operating members, and independent operation of each operating member and the key.

Of course, the present invention is not limited to the embodiments just described and many changes and modifications can be made to the latter without departing from the scope of the invention.

In particular, the present lock, or espagnolette bolt lock, which is adapted to be accommodated within the thickness of an opening panel, can equally well be mounted on said opening panel in any other manner.

Movements in the direction of the height of the casing may obviously be replaced by movements in the direction of the width of the latter, between the rear wall and the front plate, or by displacements in rotation.

There is claimed:

1. A lock adapted to be accommodated in the thickness of an opening panel, adapted to be operated from each side of said opening panel by an operating member and a key, and adapted to allow retraction of a latch bolt from the outside only by means of a key, said lock including a casing and two nuts rotatable about a common axis and attached to a respective corresponding operating member, wherein:

each nut is adapted to turn freely about its axis relative to the other nut, said latch bolt is attached to a selector member mobile in a transverse direction corresponding to the thickness of a casing of said lock between two predetermined positions, and each nut is attached to corresponding means of said lock adapted to engage with said selector member when the latter is in a position close to said nut to actuate said latch bolt when said nut is turned in a first direction corresponding to retraction of said latch bolt and to remain disengaged from said selector member when the latter is in its other position near the other nut.

2. The lock claimed in claim 1 wherein:

each nut cooperates with a corresponding flange rotatable about the axis of said nut and adapted to transmit the movement of a cylinder when the latter is actuated by said key and includes means for rotating said flange when said nut is rotated in said first direction to retract said latch bolt, and each flange includes a finger that engages with said selector member or remains disengaged from said selector member according to whether said member is in its position on the same side as the corresponding nut or in its other position.

3. The lock claimed in claim 2 wherein a key bit attached to said cylinder actuated by said key is adapted to engage respective means attached to said two flanges so as to actuate said latch bolt regardless of the position of said selector member.

4. The lock claimed in claim 1 wherein said casing of said lock includes on at least one lateral wall an opening allowing the insertion of a tool to move said selector member towards the other wall.

5. The lock claimed in claim 2 wherein:

said casing includes a first lateral wall and a second lateral wall, said two nuts are substantially symmetrical to each other about a median plane of said lock perpendicular to the common rotation axis of said nuts, said two flanges are also substantially symmetrical about said median plane, and each nut has on its lateral face on the same side as the first lateral wall and the second lateral wall, respectively a cylindrical projection coaxial with said nut and passing through a circular opening in the corresponding flange.

6. The lock claimed in claim 5 wherein one of said cylindrical projections passes through a circular opening in the first lateral wall and the other of said cylindrical projection passes through a circular opening in the second lateral wall.

7. A lock as claimed in claim 5 including means for guiding rotation of said two nuts relative to each other.

8. The lock claimed in claim 5 wherein each nut has on its cylindrical projection an attachment finger extending radially outwards from said projection and each flange has at the periphery of its circular opening a complementary curvilinear opening adapted to receive said attachment finger and to allow said finger of the corresponding nut to rotate said flange in said first direction without impeding operation of said flange by said key.

9. A lock as claimed in claim 1 constituting an espagnolette bolt lock adapted to actuate at least one link adapted to penetrate in its deployed position into a keeper of an auxiliary lock, wherein each nut is adapted to turn from its rest position in the second direction opposite said first direction and includes means adapted to engage with complementary means attached to said link in order, starting from said rest position of said nut, to deploy said link when said nut is turned in said second direction and to retract said link when said nut is turned in said first direction.

10. A lock as claimed in claim 9 including for each nut a plate mobile in the longitudinal direction of said link and attached to the latter and wherein each nut and the corresponding plate include respective complementary means to convert circular movement of said nut in one direction or the other into rectilinear displacement of said plate in one direction or the other.

11. The lock claimed in claim 10 wherein each said nut has a flange with a circular sector shaped peripheral contour delimited at both ends by a radially outwardly projecting tooth adapted to entrain a lug of said plate.

12. The lock claimed in claim 10 wherein each nut has a flange including a radial cut-out in which slides a lug adapted to slide in an opening of the corresponding plate that extends in the longitudinal direction of said link, the length of this opening corresponding to the lost motion required to enable said nut to return to its rest position after actuating said link without entraining movement of the latter.

13. A lock as claimed in claim 1 comprising, for each nut, means adapted to cooperate with a return spring to return said nut to its rest position, and, for at least one nut:

a member mobile inside said casing of said lock and adapted to move in a longitudinal direction when said nut turns about its axis in a first direction against the action of said return spring or in the opposite direction due to the action of said spring, and means attached to said nut adapted to cooperate with complementary means attached to said mobile member to convert rotation of said nut about its axis into a longitudinal movement of said mobile member and vice versa.

14. The lock according to claim 13 wherein said means attached to said nut are pinion means coaxial with said nut and said complementary means attached to said mobile member comprise a rack engaged with said pinion means.

15. The lock claimed in claim 13 wherein said spring is a coil spring extending in the longitudinal direction inside a housing formed in said casing and said mobile member includes at least one projecting member adapted to engage with a corresponding end of said spring.

16. The lock claimed in claim 15, each said nut being adapted to be turned in both directions from its rest position, wherein said mobile member includes two projecting members adapted to engage with respective corresponding ends of the associated spring.

17. A lock as claimed in claim 1 including means for manually immobilizing said latch bolt relative to an interior surface of a front plate in a position retracted inside said casing of sad lock.

18. The lock claimed in claim 17 wherein said bolt has on its bevel a cavity extending over a middle part of the height of said bevel and said cavity receives a slider extending over part only of the height of said cavity and mobile within said cavity in the heightwise direction thereof.

19. The lock claimed in claim 18 wherein said slider has a cross-section that completely fills said cavity and its bevel reconstitutes said bevel of said latch bolt.

20. The lock claimed in claim 18 wherein said cavity communicates with a second cavity extending in the heightwise direction of said bevel and formed in the mass of said bolt as far as the exterior surface of the latter and wherein said slider carries a finger adapted to slide in said second cavity when said slider slides in the first cavity, the length of said finger being such that said finger is flush with the corresponding face of said bolt when said slider is in its position distant from said second cavity and projects relative to said surface of said bolt when said slider is in its position near said second cavity, so as to abut against an interior surface of a front plate.

* * * * *